United States Patent [19]

Tomaiko

[11] Patent Number: 4,950,203

[45] Date of Patent: Aug. 21, 1990

[54] COIN COUNTER AND WRAPPER LOADING DEVICE

[76] Inventor: James Tomaiko, 364 N. Monroe, Tallmadege, Ohio 44278

[21] Appl. No.: 265,916

[22] Filed: Nov. 2, 1988

[51] Int. Cl.[5] ..... G07D 9/06

[52] U.S. Cl. ..... 453/59; 53/532; 53/254; 453/60

[58] Field of Search ..... 453/59, 60, 62; 53/254, 53/213, 532, 262, 390; 141/390, 391

[56] References Cited

U.S. PATENT DOCUMENTS

| | | | |
|---|---|---|---|
| 2,031,005 | 2/1936 | Renfroe | 53/262 |
| 2,342,761 | 2/1944 | Simpson | 453/60 X |
| 2,694,514 | 11/1954 | Stern | 53/262 X |
| 2,952,108 | 9/1960 | Ullman | 53/254 |
| 4,669,252 | 6/1987 | Steinhilber | 53/532 X |
| 4,700,533 | 10/1987 | Green | 53/254 X |

FOREIGN PATENT DOCUMENTS

| | | | |
|---|---|---|---|
| 0238236 | 10/1945 | Switzerland | 453/59 |

*Primary Examiner*—F. J. Bartuska
*Attorney, Agent, or Firm*—Oldham & Oldham Co.

[57] ABSTRACT

A coin counter and wrapper loading device comprising multiple, inclined, semicircular coin-holding troughs connected by trough separator members, and attached to a trough holding frame. The troughs have a closed lower end, and an open upper end, a hollow ring guide being positioned at the latter end having flexible speculum fingers extending therefrom, outwardly from said troughs and parallel thereto. If desired, the guide rings may be detachably connected with the device, as for example, by insertion into a collar member attached to said troughs, or to the frame holding them.

11 Claims, 2 Drawing Sheets

COIN COUNTER AND WRAPPER LOADING DEVICE

TECHNICAL FIELD

This invention relates to a device for facilitating the counting of coins and loading them into coin wrappers.

More particularly, this invention relates to a device which aligns coins of different diameters and denominations in parallel rows, each row containing coins of uniform diameter, so that predetermined numbers of coins can be placed in coin wrappers. Specifically, this invention relates to a device comprising semicircular trough-like containers, usually having diameters different from each other, which are positioned in a trough holding frame at an inclined angle from the horizontal, wherein each of the troughs has a coin wrapper positioning guide ring attached to the upper end thereof which acts as a coin wrapper speculum, guiding and facilitating entry of coins pushed upward along the troughs into coin wrappers placed over flexible finger members extending outwardly from the troughs and parallel thereto.

BACKGROUND OF THE INVENTION

One of the more onerous duties of those required in the course of their employment to handle large volumes of cash is the counting and packaging of coins forming a part thereof. In the past, it was common for those in the posession of large numbers of coins to rely on banking institutions to perform the counting and packaging task for them. Increasingly, however, such institutions refuse to accept loose change for deposit, necessitating performance of the counting and packaging operation by the depositer himself.

In response to the need, coin sorting machines have been devised which automatically process coins placed in them, packaging coins of the same denomination into tubular coin wrappers, each of which holds a specific number of coins. While such machines enable the task to be performed rapidly and relatively effortlessly, they are expensive, and most enterprises, particular smaller ones faced with counting and packaging loose change taken in the course of business transactions, are unable to justify the substantial expenditure required for their purchase.

In view of this and other disadvantages, less expensive and simpler devices have been proposed, for example, those involving cylindrical tubes closed on one end, and including a funnel on the other end. Such devices are fabricated to have a tube diameter specific to the denomination of the coin designed to be handled therein, and coins of that denomination deposited in the attached funnel are channeled downward into the tube where they are accumulated in an aligned stack. After alignment has been accomplished, the tubular coin wrapper paper is forced downward over the stacked coins in the tube to accomplish their packaging.

While the device described is relatively inexpensive, it suffers from the fact that coins deposited in the funnel tend to bridge over therein, forming obstructions which block access to the tube, and therefore prevent coin alignment. In addition, coins falling into the tube occasionally tend to dispose themselves therein at an angle to others of the coins previously deposited in the tube, preventing accumulation of the coins in a uniformly aligned stack. Furthermore, since the tubes are enclosed, misalignments resulting from such angled disposition are difficult to rectify.

While coins can also be manually loaded into coin wrapper tubes, one-by-one, the process is prohibitively labor intensive, as well as arduous, particularly when significant amounts of coins must be counted and packaged.

BRIEF DESCRIPTION OF THE INVENTION

In view of the preceding therefore, it is a first aspect of this invention to provide a device which allows a predetermined number of coins to be arranged in uniformly aligned stacks.

A second aspect of this invention is to provide a device which permits stacks of aligned coins to be readily placed in tubular coin wrappers.

A further aspect of this invention is the provision of a coin counting and wrapping device capable of accommodating the alignment of coins of differing denomination.

An additional aspect of this device is to furnish a coin counter and wrapper loading device in which the coins being processed therethrough are readily accessible to the operator of the device, facilitating the correction of any jamming which occurs.

Another aspect of this invention is to provide temporary, organized storage for an individual's loose change.

Yet a further aspect of this invention is the provision of an inexpensive device which facilitates both the counting and wrapping of loose coins.

A still further aspect of this invention is the provision of a coin counter and coin wrapper device which has replaceable coin wrapper speculum members.

The preceding and additional aspects of the invention are provided by a coin counter and wrapper device comprising a plurality of semicircular coin troughs mounted in a trough holding frame, each of said troughs having a diameter adapted to receive and hold at right angles to the longitudinal axis of said trough coins of a particular diameter, wherein one end of said trough is blocked, while the other end is open and has connected thereto a guide ring with flexible coin wrapper speculum finger members extending therefrom, said guide ring having a internal diameter substantially equal to said trough diameter, and wherein said blocked end of said trough is lower than said other end.

The preceding and still other aspects of the invention are provided by a process for packaging coins in a coin wrapper comprising aligning coins in a semicircular trough and subsequently forcing said coins through a guide ring attached at one end of said trough into a coin wrapper, one end of which is positioned over flexible speculum finger members extending from said guide ring outwardly from said trough, and parallel thereto.

BRIEF DESCRIPTION OF THE DRAWINGS

The invention will be better understood when reference had to the following figures, in which like numbers refer to like parts, and in which.

DETAILED DESCRIPTION AND BEST MODE OF THE INVENTION

Figure 1:
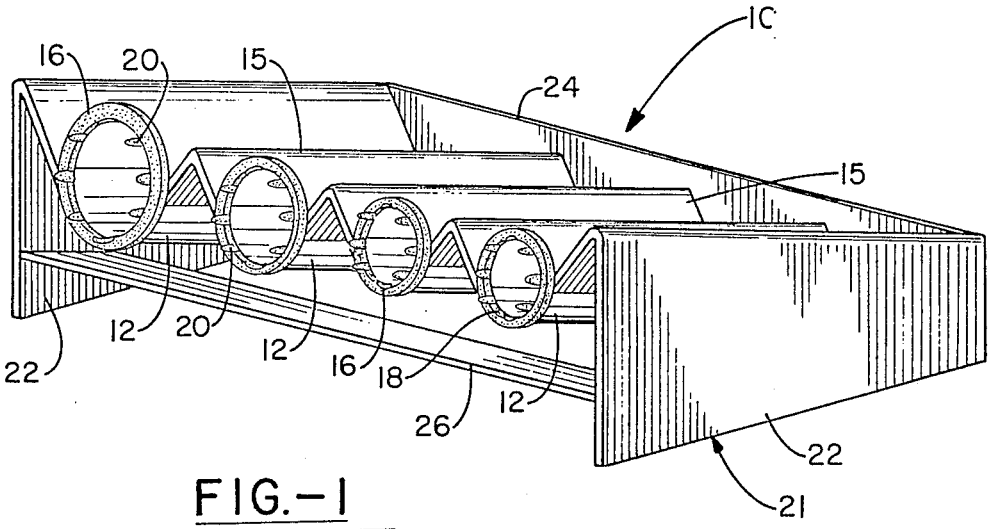
FIG. 1 is an isometric view of a coin counter and wrapper loading device of the invention.

FIG. 1 is an isometric view of a coin counter and wrapper loading device of the invention, generally 10. The device as shown, comprises multiple coin troughs 12, connected by trough separators 15, mounted in a trough holding frame, generally 21. The frame 21 includes side supports 22, and a rear support 24 attached to the side supports at right angles thereto. A frame reinforcement bar 26 is advantageously provided as a strengthening member between the side supports 22. Attached to the upper, front end of the coin troughs 12 is provided a collar member 16 which has disposed on the interior thereof guide rings 18, the latter including speculum finger members 20 extending outwardly from the trough, and parallel thereto.

The device is operated by placing coins of a given diameter in the trough having the same diameter, transverse to the longitudinal axis of the trough. Due to the inclined angle, rising back to front, of the troughs, coins so positioned maintain themselves in an upright position adjacent to each other in aligned fashion. Generally, the troughs have a length sufficient to accommodate the numer of coins required to fill the coin wrappers, and the troughs are usually completely filled with coins before loading. In the loading process, a tubular coin wrapper is positioned over the finger members 20, the latter acting as a "speculum" holding the end of the tube open during the loading process. The operator of the device normally uses one hand to hold the tube on the speculum fingers, and places the thumb of the other hand at the top of the guide ring or the collar holding it, as the case may be, and with another finger of the same hand placed behind the last coin at the lower end of the trough, employs finger pressure to push the aligned stack of coins upward along the trough, through the guide ring, and into the coin wrapper.

The components of the device may be fabricated from any of various materials, including metal, plastic, wood and the like. The use of plastic is preferred, however, since it is light and may, for example, be inexpensively fabricated by injection molding or other techniques commonly used to fabricate plastic objects.

The size of the device may be varied within broad limits, and will depend upon the number of troughs desired, the storage capacity of each trough, and similar factors. However, in the case of the embodiment of the device shown in FIG. 1, which includes a separate trough for each of pennies, nickel, dimes, and quarters, the trough holding frame within which such troughs are located will typically be about 6 to 8 inches wide, and about 3 to 4 inches deep. Conveniently, the front of the side supports will be about 3 to 4 inches high, while the rear support will be from about 2 to 3 inches high.

Figure 2:
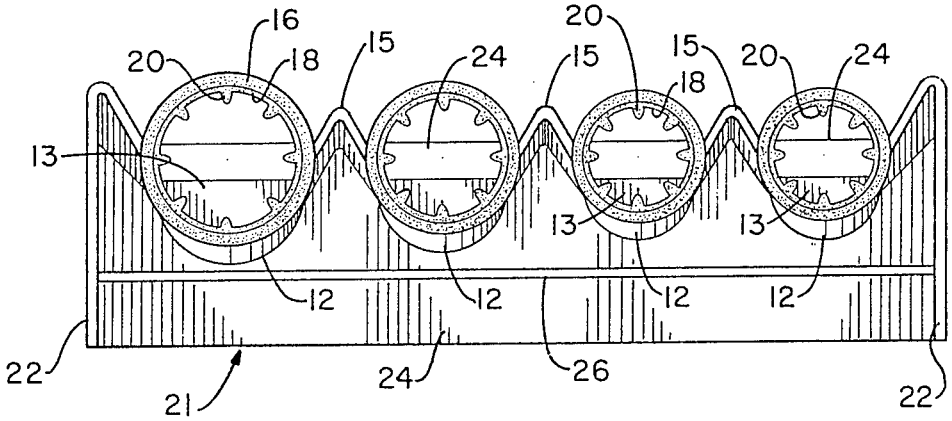
FIG. 2 is an front elevation of the device of FIG. 1.

FIG. 2 illustrates a front elevation of the device 10 of FIG. 1, particularly showing the guide rings 18 positioned in collars 16. The trough separators 15 are shown interconnecting the troughs, and attached at each side of the device to side supports 22, the latter, together with the rear support and the reinforcement bar 26, making up the trough holding frame 21.

While inclined supports, including "Vee"-shaped supports, between adjacent troughs are particularly preferred since they facilitate loading of the coins into the troughs and provide greater strength to the structure, other trough separator shapes may be used such as, for instance, horizontal separators, or others.

Figure 3:
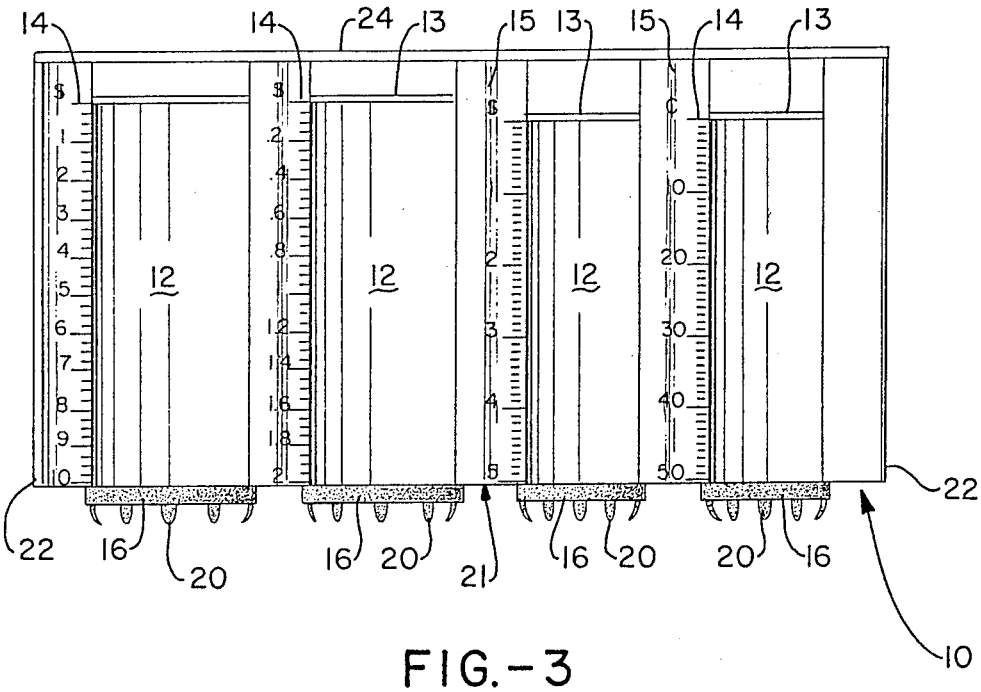
FIG. 3 is a plan view of the device of FIG. 1.

FIG. 3 shows a plan view of the device of FIG. 1, generally 10. Coin troughs 12 are mounted side-by-side in a trough holding frame 21, and as illustrated, each of the troughs 12 has a trough stop 13 therein which provides sufficient space between it and the upper, open end of the trough to accommodate whatever predetermined coins the device is intended to hold, as mentioned, usually being equal to the length of the coin wrapper which is to be filled from the device. While the troughs can extend from the front end of the frame 21 to the rear support 24, they may also terminate with the trough stop member, being supported in such case within the frame by the trough separators 15. As shown, the coin troughs are connected and supported by trough separators 15 which in the Figure are provided with a coin counting scale 14. At the upper, front end of the coin troughs 12, are mounted collars 16, into which guide rings 18, with speculum fingers 20 extending therefrom, are inserted.

As previously indicated, the dimensions of the device's components may be broadly varied, and will depend upon various factors enumerated in the preceding; however, commonly, the trough designed to accommodate pennies will be about $2\frac{7}{8}$ inches long by about $1\frac{7}{8}$ inches in diameter, accommodating 50 coins; the trough for nickels will be about 3 1/16 inches long and have a diameter of about 1 9/16 inch, providing space for about 40 coins; the coin trough for dimes will be about 2 17/32 long with a diameter of about $1\frac{1}{2}$ inch, holding about 50 coins; and the trough designed to hold quarters will be about 2 25/32 inches long, with a diameter of about 1 13/16 inch, accommodating about 40 coins.

The internal diameter of the guide rings 18 will at least equal the diameter of the coin trough associated therewith, and the ring may be permanently attached at the end of the trough. Preferably, however, the guide rings will be attached in a manner permitting them to be removed should replacement necessitated by damage, for example, to the speculum fingers 20, ever become necessary. As described, the rings 18 illustrated in FIG. 3 are detachably connected by means of a frictional fit between the rings and the collars 16 in which they are inserted.

Figure 4:
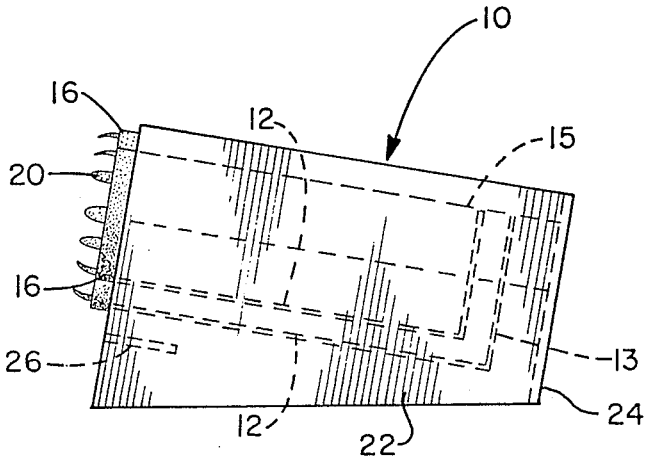
FIG. 4 is a side elevation of the device of FIG. 1.

FIG. 4 is a side elevation of the device of FIG. 1 showing the device, generally 10, comprising a trough holding frame 21 which includes side supports 22 and a rear support 24, and which is strengthened by a reinforcement bar 26. The trough separators 15 are employed to support the coin troughs 12, and guide rings with flexible speculum fingers 20 are inserted in the collars 16. The speculum finger members 20 will be inclined slightly inwardly to facilitate their insertion in the open end of the coin wrapper, but will be sufficiently flexible to allow themselves to be forced open into a position in which they are generally parallel with each other to accommodate passage of coins from the trough into the coin wrappers. The length of the fingers 20 may vary; however, a length of about $\frac{1}{4}$ to $\frac{1}{2}$ inch has been found adequate for positioning the end of the coin wrappers thereon. As mentioned, and as shown in the Figure, it is desirable to position the troughs at an angle from the horizontal so that the front, open end of the trough is higher than the lower end. While considerable latitude is permissible relative to selection of such angle, it has been found that an angle of at least about 15° will maintain the coins in the desired upright position.

While in accordance with the patent statutes a preferred embodiment and best mode of the invention has been presented, the scope of the invention is not limited thereto, but rather is measured by the scope of the attached claims.

What is claimed is:

1. A coin counter and wrapper loading device comprising a plurality of inclined semicircular coin troughs mounted in side-by-side relationship in a trough holding frame and separators separating adjacent coin troughs, said troughs and said frame being open at the top to facilitate loading of coins, each of said troughs having a diameter adapted to receive and hold at right angles to the longitudinal axis of said trough coins of a particular diameter, wherein on end of said trough is blocked, while the other end is open and has connected thereto a guide ring with flexible coin wrapper speculum finger members extending outwardly from the trough and attached to said guide ring in an essentially parallel relationship to the trough in their non-flexed position, said guide ring having an internal diameter substantially equal to said trough diameter, and wherein said blocked end of said trough is lower than said other end, the angle of inclination of said troughs being such that coins therein are maintained in a generally upright position.

2. A device according to claim 1 wherein said guide rings are detachably connected to said troughs.

3. A device according to claim 2 wherein said connection is effected by a collar member attached at the end of said trough, into which said guide ring is inserted and held by friction.

4. A device according to claim 1 which contains 4 troughs, one each, respectively, for pennies, nickels, dimes, and quarters.

5. A device according to claim 4 wherein each of said troughs has a length equal to the length of coin wrapper to be filled therefrom.

6. A device according to claim 1 in which said troughs are disposed at an angle from the plane of the bottom of said trough holding frame of at least about 15°.

7. A device according to claim 6 wherein the components of said device are fabricated from plastic.

8. A device according to claim 1 in which said separators have inclined wall surfaces.

9. A device according to claim 8 in which said separators are of generally inverted V shape.

10. A device according to claim 1 in which each said guide ring is disposed transversely to the longitudinal axis of the trough.

11. A process for packaging coins in a coin wrapper comprising aligning coins in a semicircular trough and subsequently forcing said coins through a guide ring attached at one end of said trough over flexible speculum finger members attached to said guide ring in an essentially parallel relationship to the trough in their non-flexed position and extending from said guide ring outwardly from said trough, by placing a human finger behind the last coin in the trough at the end remote from said guide ring and exerting finger pressure to push the aligned coins into the coin wrapper.

* * * * *